United States Patent [19]

Menke et al.

[11] 4,134,959

[45] Jan. 16, 1979

[54] AZOLE-PHOSPHATE CORROSION INHIBITING COMPOSITION AND METHOD

[75] Inventors: Russell O. Menke, Lindenhurst; Jose T. Jacob, Lake Zurich; Chih M. Hwa, Palantine, all of Ill.

[73] Assignee: Chemed Corporation, Cincinnati, Ohio

[21] Appl. No.: 826,009

[22] Filed: Aug. 19, 1977

Related U.S. Application Data

[63] Continuation of Ser. No. 685,008, May 10, 1976, abandoned.

[51] Int. Cl.[2] ..... C23F 11/14; C23F 11/16

[52] U.S. Cl. ..... 422/16; 106/14.12; 252/181; 252/389 A; 422/18

[58] Field of Search ..... 252/389 A, 181; 106/14.12; 422/16, 18

[56] References Cited

U.S. PATENT DOCUMENTS

| | | | |
|---|---|---|---|
| 2,742,369 | 4/1956 | Hatch | 252/389 A |
| 3,222,291 | 12/1965 | Heit et al. | 252/389 A |
| 3,510,436 | 5/1970 | Silverstein et al. | 252/389 A |
| 3,714,066 | 1/1973 | King | 252/389 A |
| 3,769,220 | 10/1973 | Willard | 252/389 A |
| 3,803,048 | 4/1974 | Hwa | 252/389 A |
| 3,837,803 | 9/1974 | Carter et al. | 252/389 A |
| 3,891,568 | 6/1975 | Nishio et al. | 252/389 A |
| 3,935,125 | 1/1976 | Jacob | 252/389 A |

*Primary Examiner*—Benjamin R. Padgett
*Assistant Examiner*—Irwin Gluck
*Attorney, Agent, or Firm*—Charles L. Harness

[57] ABSTRACT

The invention disclosed provides a new composition and method for inhibiting corrosion. The present composition is relatively non-toxic, contains no chromates and zinc, and consists essentially of an azole and a water-soluble phosphate in an effective combination. Effective amounts of the corrosion inhibiting composition are used to provide corrosion protection in both ferrous and non-ferrous metals.

1 Claim, No Drawings

AZOLE-PHOSPHATE CORROSION INHIBITING COMPOSITION AND METHOD

This application is a continuation of copending Ser. No. 685,008, filed May 10, 1976, now abandoned.

This invention relates to a method and composition for preventing corrosion of metal surfaces in contact with aqueous systems.

Water-soluble inorganic chromates are widely used to treat industrial water systems to prevent corrosion of metal parts. When these chromates are employed alone, they are used in concentrations as low as 200 ppm. and as high as 10,000 ppm., depending upon the protection needed and the permissible cost. When these chromates are used in combinations with molecularly dehydrated inorganic phosphates such as disclosed in U.S. Pat. No. 2,711,391, chromate concentrations as low as 20 ppm. have been found adequate in mild corrosive systems. Therefore, combinations of chromates and molecularly dehydrated phosphates are widely used.

Although chromates are highly effective corrosion inhibitors, their use is subject to several difficulties. Chromates cause serious skin and eye irritations, and chromates cannot be used in aqueous systems such as cooling towers or air-wash units where the resulting spray will contact people. Chromate solutions, because they are toxic, often require chemical treatment before being discharged to waste systems. Furthermore, chromates degrade organic compounds mixed therewith, limiting the types of organic compounds which can be mixed with the chromates in dry mixtures and aqueous solutions.

Azole compounds have been employed in compositions designed to control corrosion. However, azole compounds have been used only in copper alloy systems since it has been widely recognized that azole compounds are ineffective in protecting ferrous metals from corrosion.

Zinc compounds have also been used in corrosion inhibiting compositions. However, zinc compounds are toxic to aquatic life at low concentrations. Zinc solutions like, those of chromate, often require chemical treatment before being discharged to waste systems.

For these reasons, use of chromates, azole and zinc compounds in preventing ferrous metal corrosion has not been entirely satisfactory.

It has now been found, however, that by practice of the present invention there is provided a new method and composition using an azole and a water-soluble phosphate in combination to effectively control corrosion in both ferrous and non-ferrous systems while overcoming the disadvantages associated with chromate and zinc-containing compositions.

Generally stated, the corrosion inhibiting composition of the invention consists essentially of from 1 to 99 weight percent of an azole compound selected from a group consisting of pyrazoles, imidazoles, isoxazoles, oxazoles, isothiazoles, thiazoles and mixtures thereof and from 1.0 to 99 weight percent of a water-soluble phosphate. Aqueous solutions of 1 to 70 weight percent of this composition are also encompassed within this invention.

The method of this invention for preventing corrosion of metals in contact with an aqueous liquid comprises maintaining in the aqueous liquid from 0.1 to 50,000 ppm. of azole compound and from 0.1 to 50,000 ppm. of a water-soluble phosphate.

The process of this invention is useful with a wide variety of aqueous systems, that is any corrosive aqueous system in contact with metal surfaces. Suitable systems which can be treated according to this invention include cooling towers, water circulating systems, and the like wherein fresh water, brines, sea water, sewage effluents, industrial waste waters, and the like are circulated in contact with metal surfaces. These compounds are useful in radiator coolers, hydraulic liquids, antifreezes, heat transfer mediums, and petroleum well treatments. Pickling and metal cleaning baths can also be treated according to the process and composition of this invention. The process of this invention is suitable for reducing the corrosion of iron, copper, aluminum, zinc, and alloys containing these metals which are in contact with the corrosive aqueous system.

The composition of this invention is a stable corrosion inhibiting composition. Concentrations in the composition are stated as weight percents, and concentrations in the aqueous systems treated are stated as parts per million unless otherwise specified.

The compositions of this invention contain from 1 to 99 percent and preferably from 40 to 70 percent of an azole compound. Azoles are nitrogen containing heterocyclic 5-membered ring compounds. Azoles which are suitable in the composition of this invention include pyrazoles, imidazoles, isoxazoles, oxazoles, isothiazoles, thiazoles and mixtures thereof as disclosed in U.S. Pats. No. 2,618,608 and No. 2,742,369.

The pyrazoles which can be used in the composition of this invention include water-soluble pyrazoles such as pyrazole itself or a substituted pyrazole where the substitution takes place in the 3,4, or 5 position (or several of these positions) of the pyrazole ring as shown by the structural formula:

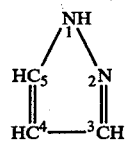

Suitable pyrazoles include pyrazole; 3,5-dimethyl pyrazole; 6-nitroindazole; 4-benzyl pyrazole; 4,5-dimethyl pyrazole; and 3-allyl pyrazole; and the like.

Imidazoles which can be used in the composition of this invention include water-soluble imidazoles such as imidazole itself or a substituted imidazole where the substitution takes place in the 2,4 or 5 position (or several of these positions) of the imidazole ring as shown here by the structural formula:

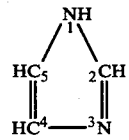

Suitable imidazoles which can be employed in the composition of this invention include imidazole; adenine, quanine; benzimidazole; 5-methyl benzimidazole; 2-phenyl imidazole; 2-benzyl imidazole; 4-allyl imidazole; 4-(betahydroxy ethyl)-imidazole; purine; 4-methyl imidazole; xanthine; hypoxanthene; 2-methyl imidazole; and the like.

Isoxazoles which can be employed in the composition of this invention include water-soluble isoxazoles such as isoxazole itself or a substituted isoxazole where the substitution takes place in the 3,4 or 5 position (or several of these positions) of the isoxazole ring as shown here by the structural formula:

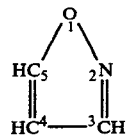

Suitable isoxazoles include isoxazole; 3-mercaptoisoxazole; 3-mercaptobenzisoxazole; benzisoxazole; and the like.

The oxazole which can be employed in the composition of this invention include water-soluble oxazoles such as oxazole itself or a substituted oxazole where the substitution takes place in the 2,4 or 5 position (or several of these positions) of the oxazole ring as shown here by the structural formula:

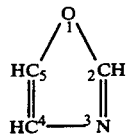

Suitable oxazoles include oxazole; 2-mercaptoxazole; 2-mercaptobenzoxazole; and the like.

The isothiazoles which can be employed in the process of this invention include water-soluble isothiazoles such as isothiazole itself or a substituted isothiazole where the substitution takes place in either the 3,4 or 5 position (or several of these positions) of the isothiazole ring as shown here by the structural formula:

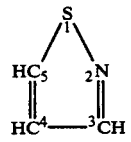

Suitable isothiazoles include isothiazole; 3-mercaptoisothiazole; 3-mercaptobenzisothiazole; benzisothiazole; and the like.

The thiazoles which can be used in the composition of this invention include water-soluble thiazoles such as thiazole itself or a substituted thiazole where the substitution takes place in the 2,4 or 5 position (or several of these positions) of the thiazole ring as shown here by the structural formula:

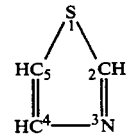

Suitable thiazoles include thiazole; 2-mercaptothiazole; 2-mercaptobenzothiazole, benzothiazole; and the like.

In the above azole compounds, the constituents substituted in the azole rings can be alkyl, aryl, aralkyl, alkylol, alkenyl, and thiol radicals so long as the substituted azole is water-soluble. Typically, substituted members have from 1 to about 12 carbon atoms.

Water-soluble phosphate which may be used herein includes materials such as phosphoric acid, disodium phosphate, sodium tripolyphosphate, tetrapotassium pyrophosphate and the like.

The composition of this invention can also contain dispersing agents such as sodium polyacrylate, sodium polymethacrylate, polyacrylamide, phosphate esters, and sulfonates; pH regulating agents; microbicides; and the like.

The treatment compositions employed in the process of this invention can be added to the water by conventional bypass feeders using briquettes containing the treatment, by adding the compounds either separately or together as dry powder mixtures to the water, or it can be fed as an aqueous feed solution containing the treatment components.

The compositions of this invention are non-toxic and prevent corrosion of metals in contact with aqueous liquids. These compositions can be substituted for chromate and zinc base corrosion inhibitors previously used where the toxicity of the chromate and zinc makes their use undesirable or where disposal of corrosion inhibiting solutions containing chromates and zinc raises serious water pollution problems requiring extensive pretreatment to remove the chromates and zinc prior to disposal of such solutions. The compositions of this invention in aqueous solutions prevent corrosion of metal parts such as heat exchangers, engine jackets, and pipes and particularly prevent metal loss, pitting, and tuberculation of iron base alloys, copper alloys, and aluminum alloys in contact with water.

The invention is further illustrated by the following specific but non-limiting examples.

EXAMPLE 1

This example demonstrates the synergistic reduction in corrosion rate obtained with the composition of this invention.

In this test, circulating water having the following composition was used.

| | |
|---|---|
| Calcium sulfate dihydrate | 714 ppm |
| Magnesium sulfate heptahydrate | 519 ppm |
| Sodium bicarbonate | 185 ppm |
| Sodium chloride | 989 ppm |

During the test, the circulating water was fed to a closed circulating test system at a rate of 5 gallons per day, the overflow from the test system being discharged to waste.

In the closed circulating system, circulating water having a temperature of 130° F. and a pH of 7.0–7.5 was fed at a rate of one gallon per minute to a coupon chamber containing test coupons for the corrosion test. Water from the coupon chamber was then passed through an arsenical admiralty brass tube for a scaling test; the tube was surrounded by a jacket through which a heating fluid having an initial temperature of 240° F. was counter-currently passed. The circulating water was then cooled to 130° F. and recirculated through the system. The total circulating time for each test was 10 days. Mild steel (SAE 1010), brass (33 wt. percent zinc, 67 wt. percent copper, ASTM B36-75, copper alloy No. 268), copper (ASTM B 152-75, copper No. 110), and aluminum (ASTM B234-75, alloy 6161) coupons having an average area of 26.2 cm.$^2$ were used in the test chamber. The coupons were carefully cleaned and weighed before use. Following the test, each coupon was cleaned with inhibited hydrochloric acid, rinsed, dried and weighed to determine the corrosion rate in mils per year.

Following each test the admiralty brass tube was removed; scale from representative areas of the tube interior was removed and weighed to determine the weight gain per unit area due to scaling.

The results obtained are shown in Table A.

TABLE A

| Example No. | Additive | Corrosion Rate in Mils per Year | | | |
|---|---|---|---|---|---|
| | | Aluminum | Steel | Copper | Brass |
| 1 | Blank (No treatment) | 9.8 | 14.9 | 1.7 | 1.4 |
| 2 | 2-Mercaptobenzothiazole (I) 5ppm | 0.7 | 20.0 | 0.3 | 0.3 |
| 3 | Phosphoric acid (II) 3 ppm | 16.2 | 15.5 | 1.1 | 1.3 |
| 4 | Sodium tripolyphosphate (III) 4.8 ppm | 16.5 | 14.9 | 2.2 | 1.9 |
| 5 | I 5 ppm, + II 3 ppm | 1.2 | 4.6 | 0.3 | 0.3 |
| 6 | I 5 ppm, + II 4.5 ppm | 0.8 | 1.8 | 0.3 | 0.3 |
| 7 | I 5 ppm, + III 4.8 ppm | 0.4 | 6.1 | 0.2 | 0.2 |

The advantage of having an azole compound is evident by comparing the foregoing results. As shown in Table A, a synergistic corrosion rate reduction was observed with each of the metals tested when the circulating water was treated according to this invention. The continuation of compounds was better than would be expected from the results obtained using the compounds alone. Furthermore, synergistic scale reduction was also observed.

The following compositions according to this invention show similar unexpected corrosion reductions when tested by the procedure described in Example 1.

| Example No. | Ingredients - Weight Percent |
|---|---|
| 8 | 4-Benzyl pyrazole 42%, trisodium phosphate dodecahydrate 58% |
| 9 | 2-Methyl imidazole 10%, tetrapotassium pyrophosphate 90% |
| 10 | Imidazole 5%, dipotassium phosphate 95% |
| 11 | 3-Mercaptobenzisoxazole 11%, monosodium phosphate monohydrate 89% |
| 12 | Isoxazole 40%, sodium tripolyphosphate 60% |
| 13 | 2-Mercaptoxazole 67%, disodium phosphate heptahydrate 33% |
| 14 | 2-Mercaptobenzoxazole 82%, trisodium phosphate decahydrate 16%, sodium polymethacrylate 2% |
| 15 | Isothiazole 95%, tetrasodium pyrophosphate 5% |

-continued

| Example No. | Ingredients - Weight Percent |
|---|---|
| 16 | Benzisothiazole 41%, disodium phosphate dihydrate 55%, glycerol phosphate 4% |
| 17 | Benzisothiazole 3%, tetrapotassium pyrophosphate 5%, water 92% |
| 18 | 2-Mercaptobenzothiazole 2%, potassium hydroxide 4%, phosphoric acid 2%, water 92% |
| 19 | Benzothiazole 25%, disodium phosphate dihydrate 70%, sodium acrylate-acrylamide copolymer 5% |
| 20 | Thiazole 62%, tripotassium phosphate 35%, potassium polyacrylate 3% |
| 21 | 2-Mercaptobenzothiazole 1,5%, potassium hydroxide 5%, phosphoric acid 2%, sodium lignosulfonate 2%, water 89.5% |
| 22 | Sodium mercaptobenzothiazole 46%, tripotassium phosphate 54% |
| 23 | Sodium mercaptobenzothiazole 43%, tripotassium phosphate 54%, glycerol phosphate 3% |
| 24 | 2-Mercaptothiazole 22%, trisodium phosphate dodecahydrate 74%, polyacrylamide 4% |
| 25 | 3,5-Dimethyl pyrazle 21%, trisodium phosphate decahydrate 76%, sodium polyacrylate 3%. |

Obviously many modifications and variations of the invention as hereinabove set forth can be made without departing from the essence and scope thereof, and only such limitations should be made as are indicated in the claims.

What is claimed is:

1. A method for preventing corrosion of steel in contact with an aqueous liquid consisting of maintaining in the aqueous liquid from 0.1 to 50,000 ppm of an azole compound selected from the group consisting of pyrazoles, imidazoles, isoxazoles, oxazoles, isothiazoles, thiazoles and mixtures thereof and from 0.1 to 50,000 ppm of water-soluble phosphate selected from the group consisting of phosphoric acid, trisodium phosphate, dipotassium phosphate, monosodium phosphate, disodium phosphate, and tripotassium phosphate.

* * * * *